US007051817B2

(12) United States Patent
Shaposhnikov et al.

(10) Patent No.: US 7,051,817 B2
(45) Date of Patent: May 30, 2006

(54) DEVICE FOR IMPROVING OIL AND GAS RECOVERY IN WELLS

(75) Inventors: Vladimir M. Shaposhnikov, Brooklyn, NY (US); Leonid Levitan, Brooklyn, NY (US)

(73) Assignee: Sorowell Production Services LLC, Waloon Lake, MI (US)

( * ) Notice: Subject to any disclaimer, the term of this patent is extended or adjusted under 35 U.S.C. 154(b) by 0 days.

(21) Appl. No.: 10/914,026

(22) Filed: Aug. 9, 2004

(65) Prior Publication Data

US 2006/0027372 A1 Feb. 9, 2006

(51) Int. Cl.
*E21B 43/00* (2006.01)

(52) U.S. Cl. ..... 166/372; 166/68; 166/370

(58) Field of Classification Search ..... 166/369, 166/370, 368, 372, 63, 68, 105, 105.5; 417/178, 417/109

See application file for complete search history.

(56) References Cited

U.S. PATENT DOCUMENTS

| | | | | |
|---|---|---|---|---|
| 216,064 A | | 6/1879 | Spencer | |
| 1,028,822 A | | 6/1912 | Honey | |
| 2,061,865 A | * | 11/1936 | Wells | 166/68 |
| 5,707,214 A | * | 1/1998 | Schmidt | 417/109 |
| 5,743,717 A | * | 4/1998 | Schmidt | 417/109 |
| 5,806,599 A | | 9/1998 | Hisaw et al. | |
| 5,899,273 A | | 5/1999 | Jung | |
| 6,382,321 B1 | | 5/2002 | Bates et al. | |
| 6,547,532 B1 | | 4/2003 | Gonzalez et al. | |
| 6,863,125 B1 | | 3/2005 | Ivannikov et al. | |
| 2002/0096332 A1 | * | 7/2002 | De Almeida | 166/319 |

* cited by examiner

*Primary Examiner*—Brian E. Glessner
*Assistant Examiner*—Bryan A. Fuller
(74) *Attorney, Agent, or Firm*—I. Zborovsky

(57) ABSTRACT

A device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device has a body having a central throughgoing opening with a shape corresponding a shape of a Laval nozzle and with a cross section which changes steplessly and gradually, and a mandrel attachable to a tubing and associated with the body without interfering with a flow of fluids.

6 Claims, 6 Drawing Sheets

A–A

B–B

DEVICE FOR IMPROVING OIL AND GAS RECOVERY IN WELLS

BACKGROUND OF THE INVENTION

The present invention relates to a device for improving oil and gas recovery in wells. It can be used in oil and gas industry for oil recovery in oil, condensate and gas fields.

One device of this type is disclosed in U.S. Pat. No. 5,893,414. The device is formed as a tubular element which, by means of a mandrel, is hermetically fixed in a tubing near an interval of perforation and has a system of cavities which are connected with one another. An inlet cone opening is located downwardly and leads to a multi-stage system of coaxially arranged Venturi pipes above the inlet nozzle, with a gradually increasing diameter in direction of flow. From the side of the inlet of the flow into the device, it retains the calculated value of gas in a dissolved condition in oil at a predetermined calculated pressure. On the other hand, the device, accelerates the two-phase flow and creates homogenous structure of gas-liquid flow in upstream direction towards the mouth the opening of the well.

The device has however some disadvantages. The multi-stage structure of the Venturi pipes leads to many small swirling of the flow which can not be accurately calculated on transitions from one diameter of the pipe to the other, so as to make difficult correct forecast of energy losses of the flow, especially in a multi-phase systems, in the device. This in turn makes impossible to forecast an optimal mode of operation of the current condition of the layer and the well, and the process of optimization of the system layer-bottomhole of the well-device-tubing-surface choke. The swirling zones in the device lead to formation of large drops of the liquid (oil-water mixture), which have a speed significantly smaller than the speed of the gas nucleus, and thereby they migrate in direction toward the wall of the tubing so as to create a ring-like mode in the inlet and flowing of the fluid down along the walls of the tubing to a bottomhole of the well. This in turn significantly increases the calculated pressure and therefore reduces efficiency of operation of the well, so as to destabilize its operation and make the process of optimization of the well longer.

Another device is disclosed in U.S. Pat. No. 6,059,040. It includes a Laval nozzle which is hermetically connected with a mandrel and is located inside it, and the mandrel in turn is fixed in a column of pipes. In the narrowest point of the Laval nozzle there are horizontal openings which connect the interior of the Laval nozzle with a space in the tubing above a packer of the mandrel. The device can be used in gas and gas-condensate wells for removal of a liquid phase accumulated in the bottomhole (condensate and water) by creating a zone of low pressure in the narrowest part of the Laval nozzle. The low pressure in this point is created by acceleration of the gas flow. The liquid phase is entrained into the gas flow and broken into small droplets with a structure in form of fog and easily travels to the surface. In the device disclosed in this reference, difficulties take place with the mounting of the device in the mandrel, since for its normal operation it is necessary to drill horizontal openings in the mandrel, which is not possible for the majority of mandrels due to their structural features.

SUMMARY OF THE INVENTION

Accordingly, it is an object of the present invention to provide a device for improving oil and gas recovery in wells.

In keeping with these objects and with others which will become apparent hereinafter, one feature of the present invention resides, briefly stated, in a device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device comprising a body having a central throughgoing opening with a shape corresponding a shape of a Laval nozzle and with a cross section which changes steplessly and gradually; and a mandrel attachable to a tubing and associated with said body without interfering with a flow of fluids.

When the device is designed in accordance with the present invention, it allows a more accurate calculations for optimization of productivity of oil-gas wells during current conditions of a joint operation of a working system layer-well.

When the device is designed in accordance with the present invention, automatic regulation of a gas-liquid flow in the device is achieved so as to provide a stable operation of the well in frequently changing conditions of operation of an interfering system of the wells, which work with a particular layer, as well as the condition of the layer within the wide range of pressures, productivity and time.

With the use of the device, a more stable multi-dispersed structure of a two-phase gas-liquid flow is created above the device and it moves to an outlet of the well in a bubble mode without deterioration into a gas-liquid, so as to reduce weight of a mixture density and to prevent formation of a ring-like mode which negatively affects the productivity of the well.

With the inventive device, parameters of the device can be calculated accurately for operation together with an outlet nipple for a smooth regulation of the system: well-bottomhole-device-tubing-outlet nipple for speedy optimization of the well in correspondence with the current condition of the layer.

Also, the device can be arranged with horizontal openings so that it enhances the most efficient withdrawal of liquid from the bottomhole of gas and gas-condensate wells.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
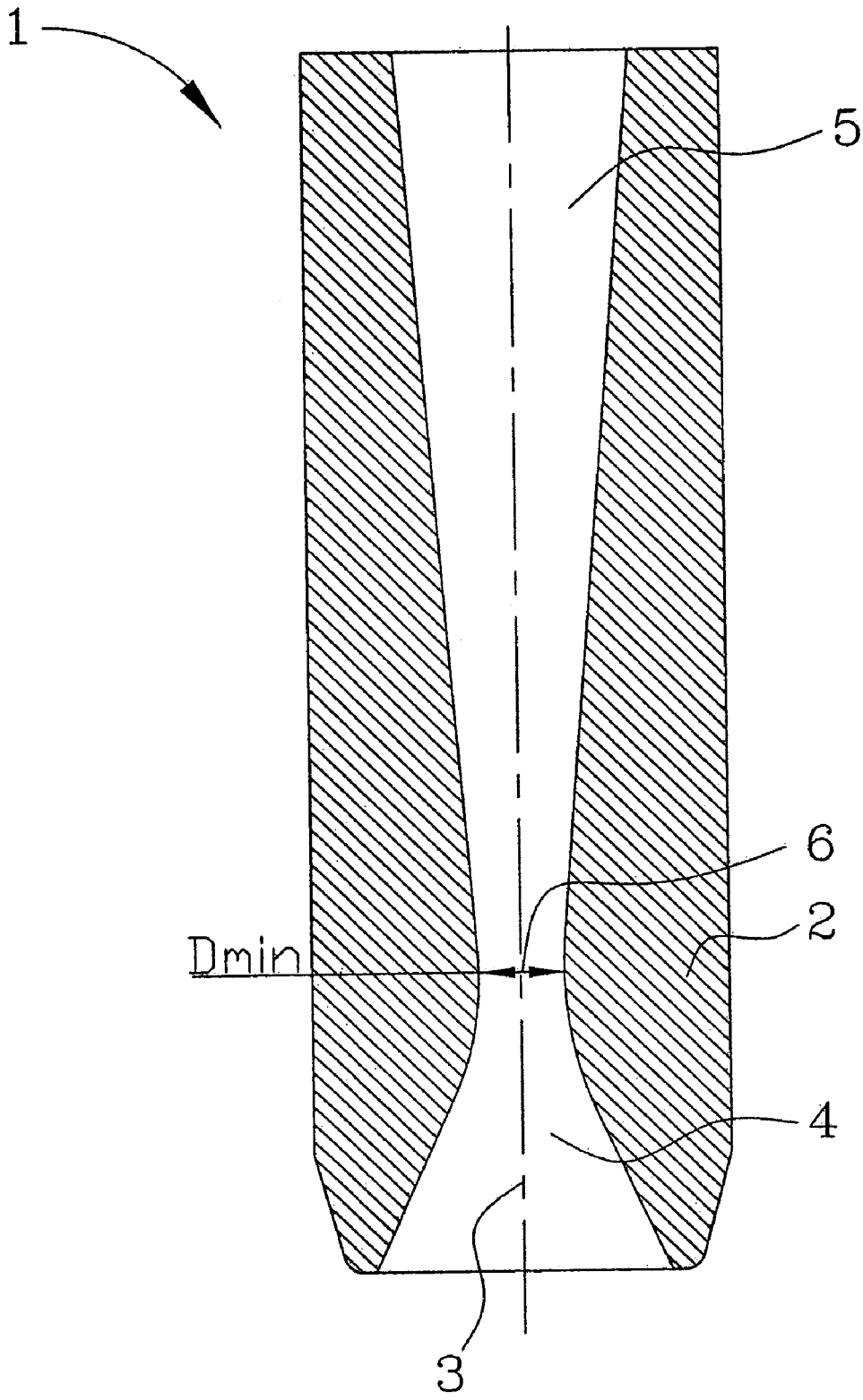
FIG. 1 is a view schematically showing a device for improving recovery of oil and gas in accordance with the present invention.

A device in accordance with the present invention is shown in FIG. 1 and identified as a whole with reference numeral 1. It has a body 2 with a central throughgoing opening 3. The body 2 has a solid, impermeable wall without holes. The throughgoing opening 3 has the shape of Laval nozzle. It has a cross-section which changes in an axial direction smoothly, without steps. The opening 3 has two substantially conical parts 4 and 5 which are connected with one another at their narrowest locations 6.

An inlet part 4 of the opening 3 is shorter and it is generally identified as a confusor, while the outer portion 5 is longer and is usually identified with a diffuser. The size of the portions 4 and 5 of the inner opening 3 depends on current parameters of the layer (layer pressure, current pressure of saturation, gas content, water content, porosity, permeability, density of oil, water, gas, etc), and also on parameters of operation of the well (around the clock production, the nature of production-oil, water, gas, condensate), an inlet pressure, a size of an inlet nozzle, a pressure in a line, a pressure in a separator, etc.

Based on these parameters, with the use of computer program a specific design of the device is calculated with corresponding sizes, in accordance with which the device is produced.

The device is fixed to mandrels of different types, and with the mandrel it is lowered to a desired calculated depth as close as possible to an interval of perforation. It is fixed and kept hermetically closed by means of mandrel packers and kept in this position to provide the device operation.

When the efficiency of the device is reduced due to significant natural changes in the parameters of the layer, a new device is calculated and made which correspond to new current parameters of the operation of the system the layer-well, and the new device by the mandrel and known means is lowered and replaced the old one.

Figure 2:
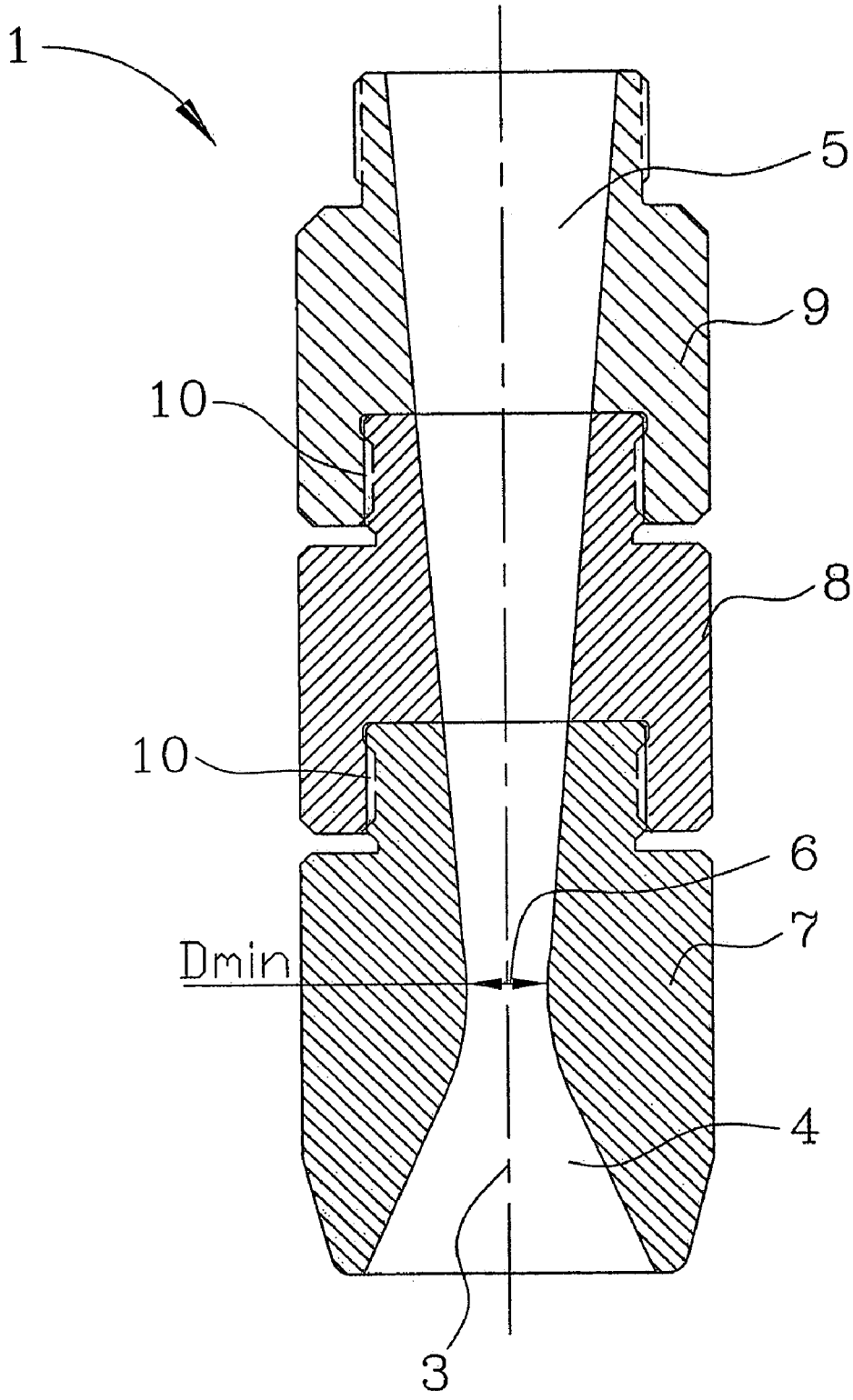
FIG. 2 is a view showing another embodiment of the device composed of several part.

While in FIG. 1 the device is shown as an integral, single piece part, it can be composed of several parts as shown in FIG. 2. The parts of the device which are identified with reference numerals 7, 8, 9, can be connected with one another by known means, for example by thread 10. Such a device can be easier and simpler to manufacture.

Figure 3:
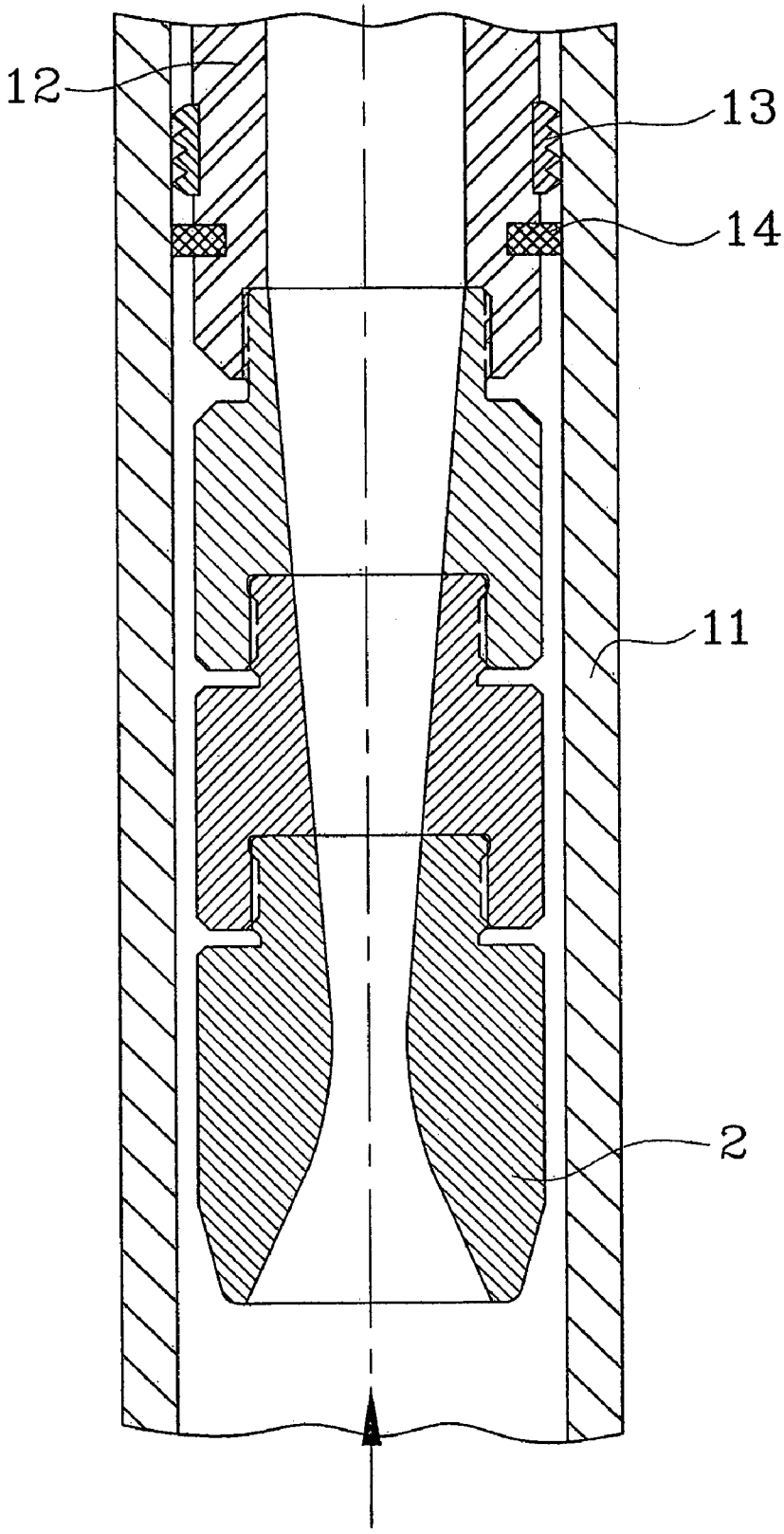
FIG. 3 is a view showing the installation of the inventive device in a well.

FIG. 3 shows an arrangement of the device in the well and its connection with a tubing by means of a mandrel. Reference numeral 11 identifies the tubing, reference numeral 12 identifies a mandrel of any type, reference numeral 13 identifies a gripper mechanism of the mandrel, reference numeral 14 identifies a packer of the mandrel. The body 2 is located below the mandrel 12. The device improves production of oil and gas condensate.

Figure 4:
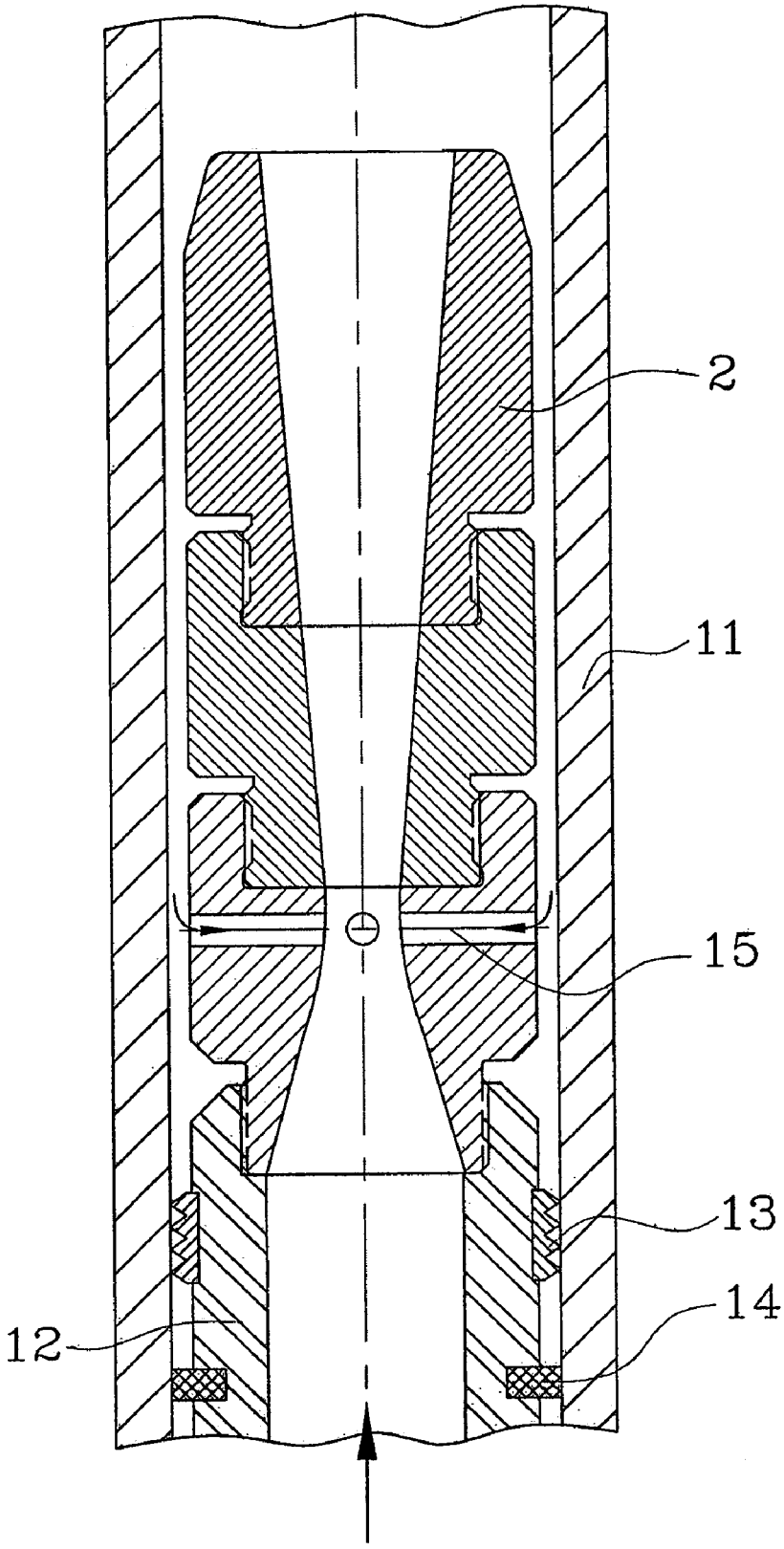
FIG. 4 a view showing the installation of a second arrangement of the device in accordance with the present invention in a well above the mandrel.

When the device is used for removal of liquid from the bottomhole of gas and gas-condensate wells, the body with horizontal openings 15 is mounted above the mandrel, as shown in FIG. 4, or it is arranged at the end of the tubing without the mandrel by means of another element.

In a further embodiment shown in FIG. 5 the body 2 with the horizontal openings 15 is located below the mandrel and a packer 16 for mounting of the mandrel is provided with a vertical passage 17 formed for example as a longitudinal opening through which liquid and gas condensate can pass and then passing through the horizontal openings.

This device can be installed without these longitudinal opening, also depending on flow conditions.

Figure 5:
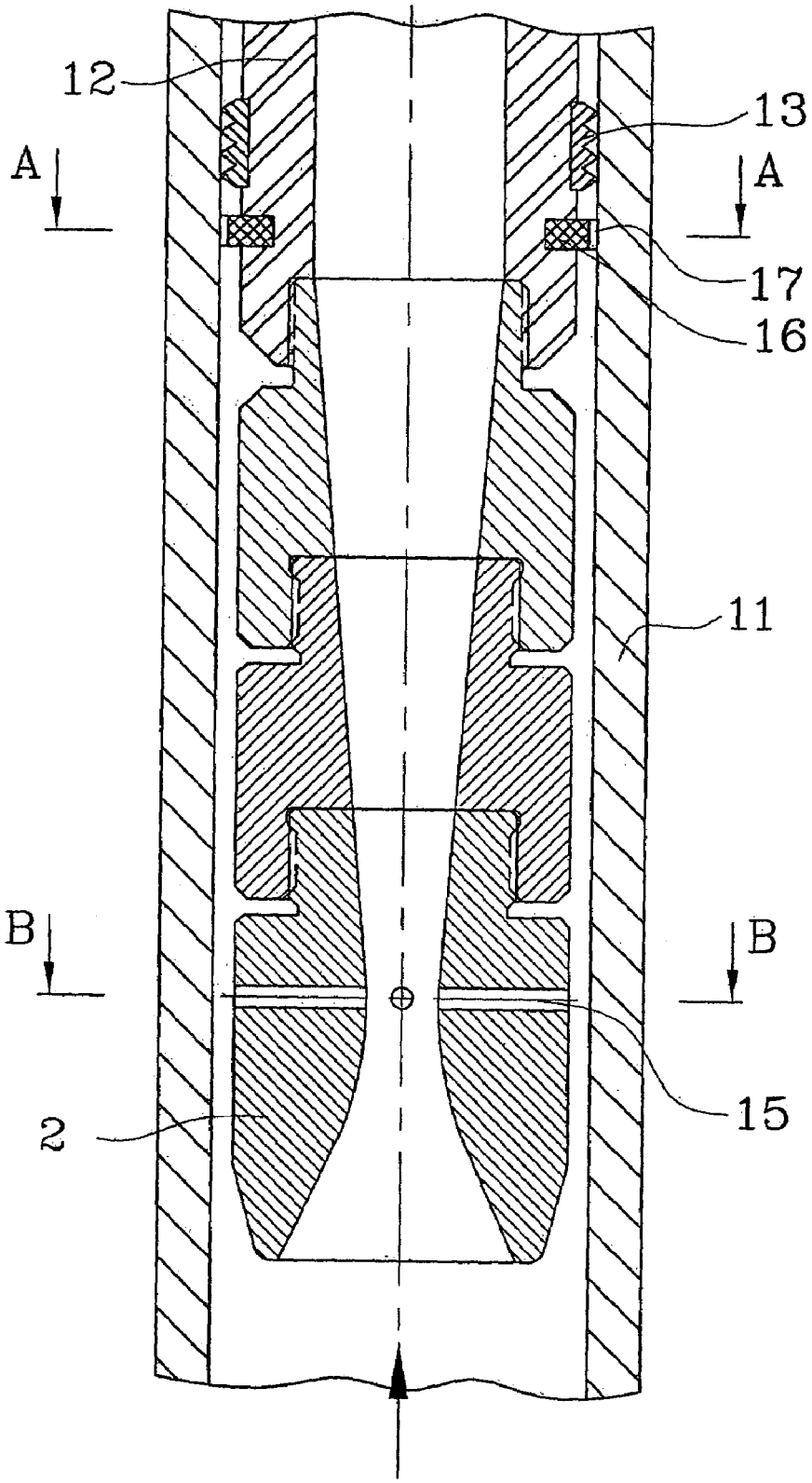
FIG. 5 is a is a view similar to the view of FIG. 5, but with installation installation under the mandrel.
Figure 6:
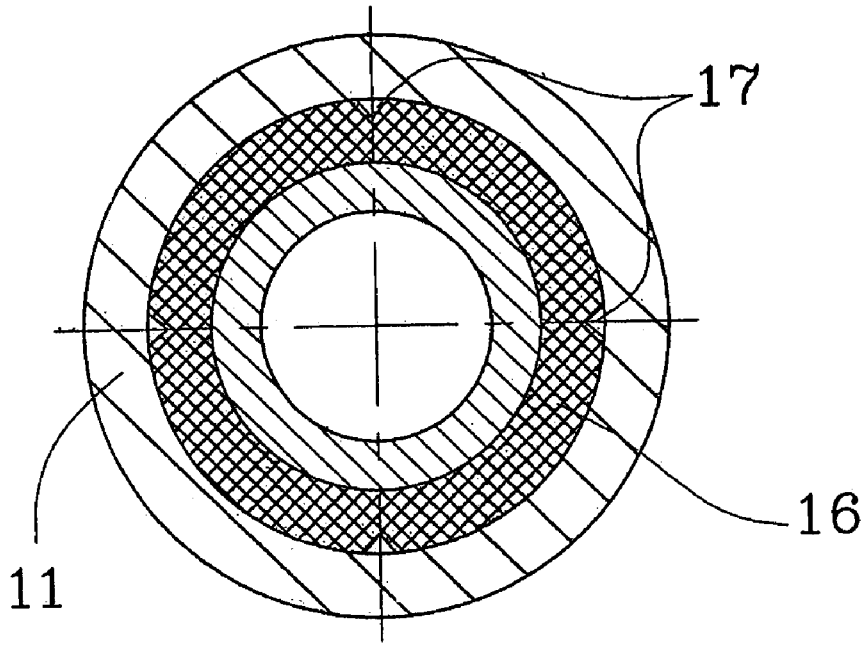
FIG. 6 is a cross section of FIG. 5 with a further modification of the inventive device.
Figure 6:
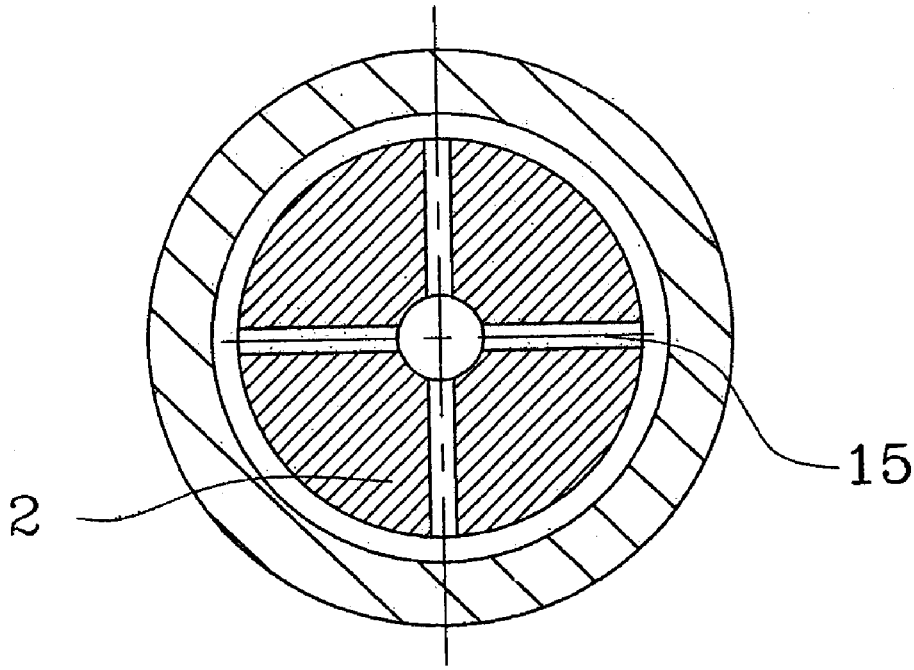

FIG. 5 shows the cross-section (of packer A—A and horizontal holes B—B) of the second arrangement of the device.

The inventive device generates a completely homogenous gas-liquid flow in a well due to elimination of the stepped zones in a system of Venturi pipes, which create sources of swirling with resulting energy losses. The parameters of the device calculated from current data of the layer and the well can provide accurate forecast without deviations from real conditions of the regulating process and optimization of the system layer-well by the device and the inlet nozzle. The elements of automatic regulation of the bottomhole device are used fuller, a mono-dispersed structure is provided for the gas-liquid flow and it can move toward the inlet of the well without deterioration into gas and liquid, and annular regime mode is not formed. Efficiency of recovery and time of operation of the well with the device significantly increases, so as to increase a daily productions of oil and a coefficient of oil recovery as a whole. Liquid is removed from the bottomhole of the well fast and efficient, and therefore productivity of gas and gas-condensate wells are increased due to reduction of bottomhole pressure to to a calculated level.

The advantages of the device in accordance with the present invention can be clearly understood from comparison of a hydraulic calculation of the known apparatus with seven Venturi pipes and a new apparatus, with identical inlet and outlet openings, the total length and length of the narrowest part of the device, with respect to the well Rodador 179 (Mexico).

The well productivity was as follows: oil—138 $m^3$/day, water—56 $m^3$/day or 29%, and gas 31200 $m^3$/day. Bottomhole pressure was 2848 psi, the outlet pressure was 569 psi, with a diameter of the outlet nozzle 26/64, the measured layer pressure was 3020 psi. The depth of the well to the lower holes of perforation was 8423 feet. Oil density was 25 api, water 1.19, gas 0.838.

The prior device with the Venturi pipes before lowering into the well was calculated for pressure drop 107 psi, and the bottomhole pressure had to reduce the depression (difference reservoir and bottomhole pressure) by 15%. The productivity of the well had to be increased also approximately by 15%.

In actuality, after the first test, the yield of oil increased to 153 $m^3$/day or in other words by 11%. The yield of gas and water reduced by 25%. However, as a result of an attempt to increase the oil recovery even more and to reduce content of water during a subsequent regulation of the well, it was not possible to go beyond the range 1/64"-1 5/64" on adjustable top chock. Negative phenomena appeared in form of a fast drop of gas volume of a main source of energy in this layer. In other words the possibility of regulation of well turned to be very limited.

A calculation of pressure drop in the device in accordance with the present invention shows a drop in the device only by 65 psi. In other words, the magnitude of local resistance in the prior art device was by 42 psi or by 39% greater than in the inventive device. This shows that the calculation for the inventive device is much more accurate.

The use of the device in accordance with the present invention can increase the range of regulation at the outlet up to 5/64"-6/64", and maybe even more, which is extremely important for conditions of significant fluctuations of layer and well parameters during a long time, so as to maintain and optimize the operation of the well when the device is located in the well.

It will be understood that each of the elements described above, or two or more together, may also find a useful application in other types of constructions differing from the types described above.

While the invention has been illustrated and described as embodied in device for improving oil and gas recovery in wells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device comprising a body having a central throughgoing opening with a shape corresponding to a shape of a Laval nozzle and with a cross section which is changed steplessly and gradually; and a hollow mandrel attachable to said body and to a tubing, so as to attach said hollow body to the tubing, said body being located outside said mandrel in a position above said mandrel in the direction of flow and being aligned with said mandrel without interfering with a flow of fluids.

2. A device as defined in claim 1, wherein said body is formed as an integral, one-piece element provided with said throughgoing opening having said shape and said cross-section.

3. A device as defined in claim 1; and further comprising means for connecting said body hermetically with said mandrel for joint lowering into a well, arrangement on a desired depth, heremetization and lifting of said body for replacement of the device.

4. A device as defined in claim 1, wherein said body has substantially horizontal openings for creating a pass to zone of low pressure and removing liquid from a bottomhole.

5. A device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device comprising a body having a central throughgoing opening with a shape corresponding to a shape of a Laval nozzle and with a cross section which is changed steplessly and gradually; and a hollow mandrel attachable to said body and to a tubing, so as to attach said hollow body to the tubing, said body being located outside said mandrel and being aligned with said mandrel without interfering with a flow of fluids, wherein said body is composed of at least two portions located near one another in a direction of an axis of said opening and together forming said opening with said shape and said cross-section.

6. A device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device comprising a body having a central throughgoing opening with a shape corresponding to a shape of a Laval nozzle and with a cross section which is changed steplessly and gradually; and a hollow mandrel attachable to said body and to a tubing, so as to attach said hollow body to the tubing said body being located outside said mandrel and being aligned with said mandrel without interfering with a flow of fluids, wherein said body has a substantially horizontal throughgoing opening; and a packer provided for mounting of said mandrel and having a throughgoing opening, so that a fluid can pass through said throughgoing opening of said body and through said throughgoing opening of said packer.

* * * * *